United States Patent [19]

Crystal

[11] Patent Number: 4,673,305

[45] Date of Patent: Jun. 16, 1987

[54] PRINTWHEEL FOR USE IN A SERIAL PRINTER

[75] Inventor: Richard G. Crystal, Los Altos, Calif.

[73] Assignee: Xerox Corporation, Stamford, Conn.

[21] Appl. No.: 811,062

[22] Filed: Dec. 19, 1985

[51] Int. Cl.[4] ..... B41J 1/30

[52] U.S. Cl. ..... 400/460; 400/144.2; 400/457; 400/174

[58] Field of Search ..... 400/457–461, 400/144.1, 144.2, 144.3, 174, 175

[56] References Cited

U.S. PATENT DOCUMENTS

| | | | |
|---|---|---|---|
| 3,613,856 | 10/1971 | Reed | 400/144.3 |
| 3,840,105 | 10/1974 | Kittredge | 400/144.3 |
| 3,907,091 | 9/1975 | Meier et al. | 400/144.3 |
| 3,970,186 | 7/1976 | Sohl et al. | 400/144.3 |
| 4,060,162 | 11/1977 | Frechette | 400/144.2 |
| 4,074,798 | 2/1978 | Berger | 400/174 |
| 4,093,059 | 6/1978 | Sohl | 400/174 |
| 4,385,847 | 5/1983 | Avison | 400/174 |
| 4,425,045 | 1/1984 | Crystal | 400/144.2 |
| 4,582,437 | 4/1986 | Wang | 400/174 |
| 4,591,282 | 5/1986 | Bradley | 400/191 |

*Primary Examiner*—William Pieprz

*Attorney, Agent, or Firm*—Serge Abend

[57] ABSTRACT

A printwheel, for use in a serial printer, in which the spokes pass in contact with a printwheel alignment member, which contact is a noise generation and wear inducing source. The printwheel is designed to include a noise and wear reducing element. The printwheel spokes terminate in character pads bearing type faces on one side thereof and are hammered on their opposite side. A wiping element is secured to the printwheel hub and lies adjacent to the spokes on the hammered side. The wiping element includes a ring of continuous, low mass, flexible material, having a wear resistant surface. The ring is located immediately radially inwardly of the character pads.

7 Claims, 3 Drawing Figures

PRINTWHEEL FOR USE IN A SERIAL PRINTERP

FIELD OF THE INVENTION

This invention relates to a printwheel for use in a serial impact printer and, more particularly, to a printwheel incorporating a wiping element to be used in a quiet printer, the printer having a noise generating character positioning member, and the wiper reducing noise and printwheel wear.

BACKGROUND OF THE INVENTION

The office environment has, for many years, been the site of objectionable noise generators, namely, typewriters and high speed impact printers. Where several such machines are placed together in a single room, the cumulative noise pollution is disturbing and may even be harmful to the health and well being of the machine operators and other occupants. The situation is well recognized and has been addressed by governmental bodies as well as by the technical community. Legislative and regulator bodies have set standards for maximum acceptable noise levels in office environments. In response to the call for a more healthful office environment, attempts have been made to reduce the noise by several methods: enclosed impact printers in sound attenuating covers; designing impact printers in which the impact noise is reduced; and designing quieter printers based on non-impact technologies, such as ink jet and thermal transfer.

Typically, conventional impact printers generate an average noise in the range of 70 to just over 80 dBA, which is deemed to be intrusive. When reduced to the 60–70 dBA range, the noise is construed to be objectionable. Further reduction of the impact noise level to the 50–60 dBA range would improve the designation to annoying. Clearly, it would be desireable to reduce the impact noise to a dBA value in the low to mid-40's. This represents a very aggressive dropoff in printer impact noise. Loudness levels measured on a dBA scale represent human perceived levels of loudness as opposed to absolute values of sound intensity. When considering sound energy represented in dBA (or dB) units, it should be borne in mind that the scale is logarithmic and that a 10 dB difference means a factor 10, a 20 dB difference means a factor of 100, a 30 dB difference means a factor of 1000, and so on.

It should be apparent that the printing noise referred to is of an impulse character and is primarily produced as the hammer impacts and drives the type character elements against the ribbon, the print sheet and the platen with sufficient force to release the ink from the ribbon. This impact noise masks other noises in the system. However, once the impact noise has been substantially reduced, the other noises associated with the operation of the printer will no longer be extraneous. Therefore, the design of a truly quiet printer requires the designer to reduce all other noise sources, such as those arising from carriage motion, character selection, ribbon lift and advance as well as from miscellaneous clutches, solenoids, motors and switches.

A quiet printer is disclosed in U.S. Ser. No. 751,169 filed on July 2, 1985 in the name of Andrew Gabor and entitled "Quiet Impact Printer". This application is assigned to the same assignee as the present invention. In the impact printer of that invention, a heavy mass is set in motion to accumulate momentum, for delivery to the platen by a movable hammer, or print tip, through a suitable linkage. The print tip drives a selected character pad of a printwheel across a throat distance, from its home position, against an inke releasing ribbon and then to the surface of the image receptor sheet, held adjacent to a platen. The entire excursion of the driven character pad includes an accurately controlled rapid pre-contact movement, through a throat distance of about 50 mils, and then a postcontact deformation, or penetration movement of about 5 mils. The contact velocity must be kept low for inherently quieter operation. In fact, the velocity of the print tip may be substantially arrested immediately prior to contact with the platen.

In order to accurately establish the pre-contact velocity profile, the throat distance must be accurately controlled. This is accomplished by providing a stationary reference position surface, on the reciprocating carriage, strategically located with respect to the printwheel and the platen. As the printwheel spokes pass against this reference surface they will be moved toward the platen to establish the proper throat distance.

It should be noted the U.S. Pat. No. 3,840,105 (Kittredge) entitled "Guide and Alignment Member" discloses a wire form member which prevents interference between out-of-line printwheel spokes and the hammer. The wire also serves to position the spokes at a given reference position before impact is achieved, for controlling the impact energy. As the rapidly rotating printwheel spokes pass against the alignment member a "picket fence" noise is generated. This phenomenon is analogous to the noise generated by rapidly moving a stick along a picket fence. However, since the Kittredge printer is no doubt a conventional impact printer, circa 1973, the "picket fence" noise would not be obtrusive as it would have been masked by the other noises, primarily the impact noise.

The printwheel of the present invention is to be used in a quiet printer, wherein the impact noise has been substantially reduced. In such a printer, other sources of noise such as the "picket fence" noise, become appreciable and objectionable. Therefore, it is the primary object of the present invention to eliminate the "picket fence" noise by suitably modifying the printwheel.

It is a further object of this invention to eliminate wearing of the printwheel spokes as they pass over the reference position surface.

SUMMARY OF THE INVENTION

The objects of the present invention may be achieved, in one form, by providing a printwheel including a hub and a plurality of radially outwardly extending spokes. The spokes terminate in character pads bearing imprinting character surfaces on the printing side of the printwheel and spoke alignment surfaces on the hammered side of the printwheel. A wiping element is secured to the printwheel hub and lies adjacent to the spokes on the hammered side. The wiping element includes a ring of continuous, flexible material, having a wear resistant surface, the ring being located radially inwardly of the character pads.

BRIEF DESCRIPTION OF DRAWINGS

The advantages of the present invention will be understood by those skilled in the art, through the following detailed description when taken in conjunction with the accompanying drawings in which.

DETAILED DESCRIPTION OF THE ILLUSTRATED EMBODIMENT

Figure 1:
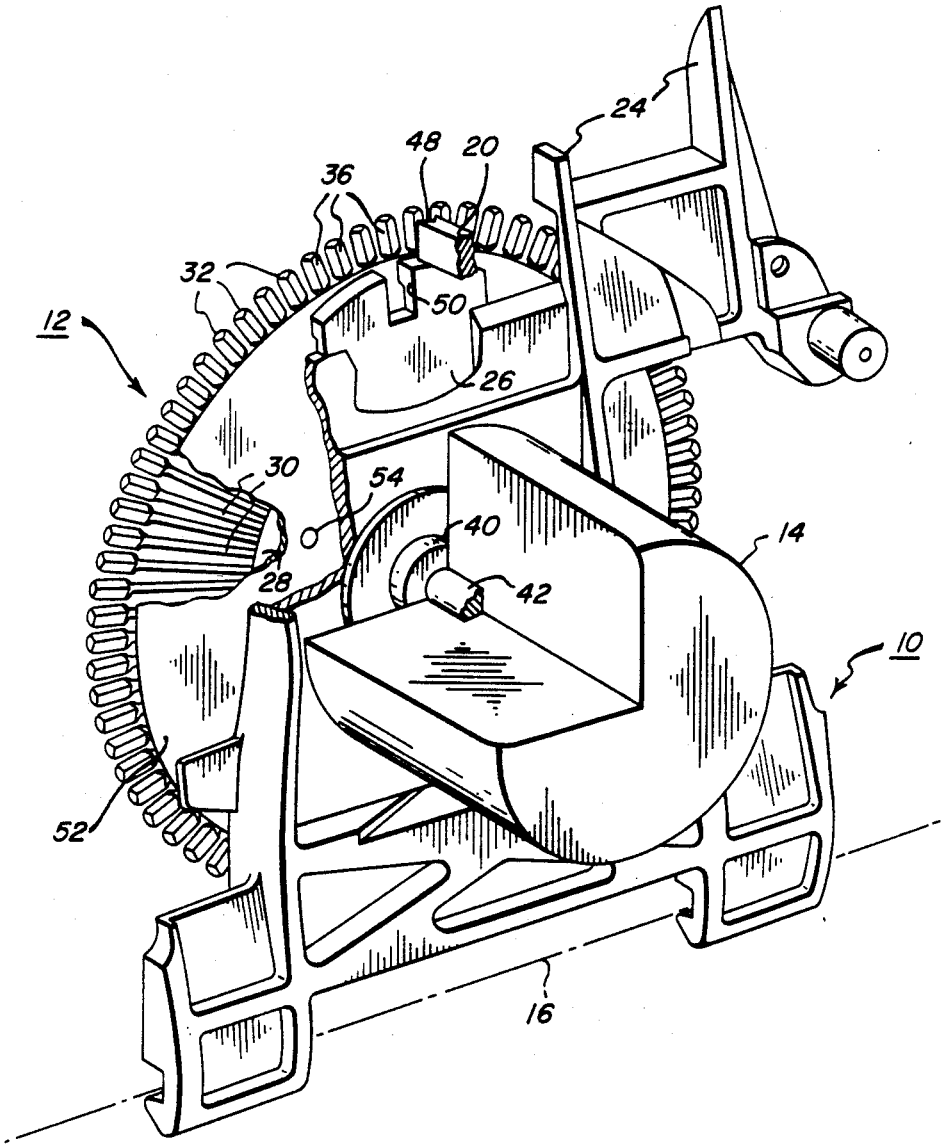
FIG. 1 is a perspective view showing the unique printwheel of the present invention and its mounting and positioning arrangement.
Figure 2:
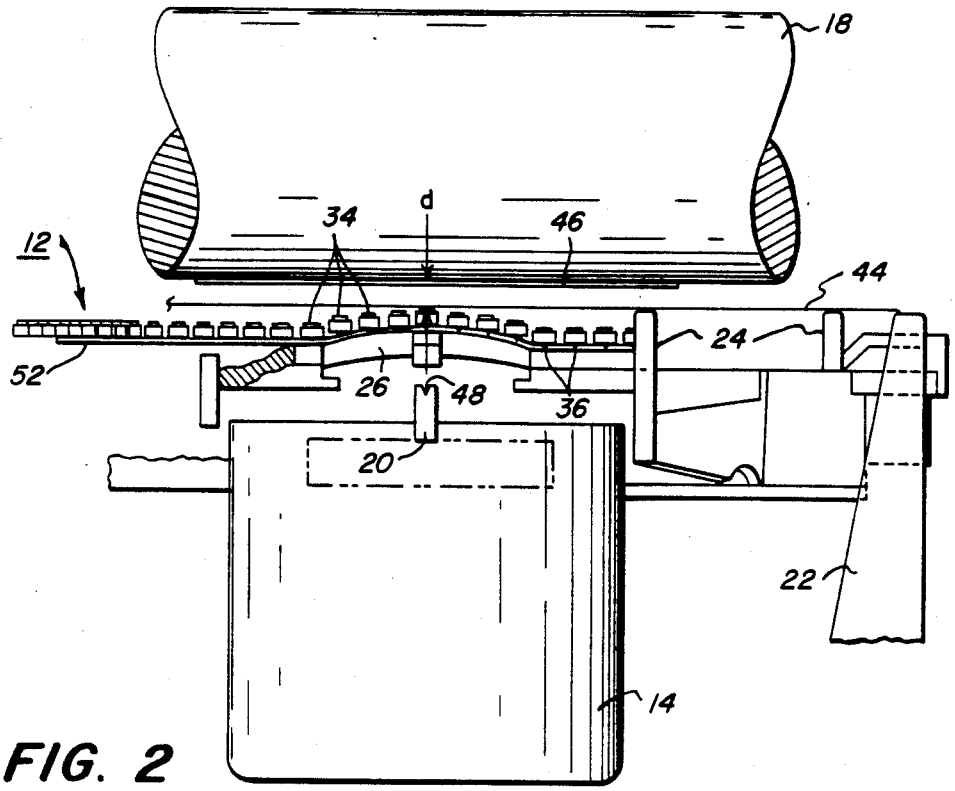
FIG. 2 is a plan view showing the unique printwheel relative to its positioning member, the print tip, the ribbon and the platen.

Turning now to the drawings, there is illustrated a pivotable member of the printer carriage 10 which supports a printwheel 12 and a printwheel motor 14 for movement about pivot axis 16 toward and away from platen 18 (seen in FIG. 2). As is well known, the carriage (not shown) is mounted on the printer for reciprocating movement along an axis parallel to the axis of the platen, for serially positioning the printwheel and the print tip of the hammer at print locations. The pivotable member is provided to allow the operator access to insert and to remove the printwheel. Also movable with the pivotable member, are the print tip 20, the ribbon cartridge 22 (only a portion shown in FIG. 2), integral ribbons guides 24 and printwheel alignment member 26.

The printwheel 12 comprises a hub 28 from which radial spokes 30 extend, each spoke terminating in a character pad 32 one side bearing a printing type face 34 and the opposite side bearing a spoke alignment wedge 36. At the center of the hub there is a ring of teeth 38 which are driven by a set of mating teeth on drive hub 40 secured to the drive shaft 42 of printwheel motor 14. During the printing operation, the printwheel 12 is rapidly rotated, from one character position to the next and the selected character pad is momentarily stopped in front of the print tip 20. The print tip is timed to advance and to drive the selected character toward the platen 18 and against the ribbon 44 and image receptor sheet 46 to impact them between the character type face 34 and the platen, for transferring ink from the ribbon surface to the sheet. It should be noted that the print tip is provided with a V-shaped notch 48 for mating with the spoke alignment wedge 36 to assure lateral alignment of the character type face on the print line. The spoke must be free to move laterally. Furthermore in a recently filed copending patent application, assigned to the same assignee as the present invention, sent to the U.S. Patent and Trademark Office on Dec. 3, 1985 and identified by U.S. Ser. No. 804,955 filed 12-5-85 in the names of Richard G. Crystal and Andrew Gabor, entitled "Impact Printer With Application of Oblique Print Force", it is set forth that upon impact, the print tip also moves the character pad radially, slightly stretching the spoke. The spoke must therefore be free to move radially in respose to application of the hammer force.

As set forth above, the throat distance "d" must be accurately established for proper rapid operation of the printer. In view of this close spacing, of about 50 mils, it would be impractical to mount the printwheel so that its plane is spaced from the platen by this small distance, because out-of-plane spokes are to be expected in molded printwheels and as the result of operator mishandling, during insertion and removal. Some of the out-of-plane spokes will certainly extend toward the platen and these will have a propensity to snag the ribbon by coming up from underneath it on its front side, and flip the ribbon to the rear side of the printwheel, rendering it inoperative.

Figure 3:
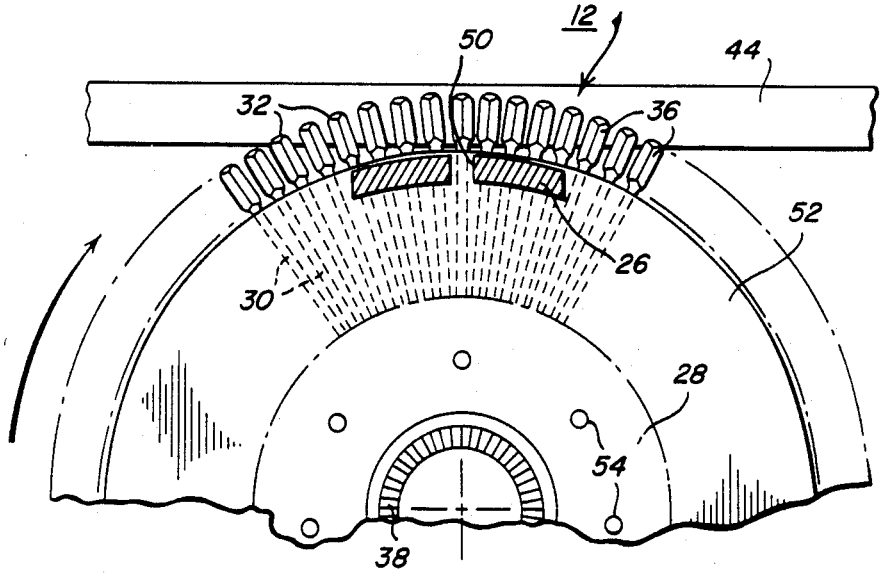
FIG. 3 is an elevation view showing the unique printwheel relative to its positioning member and the ribbon.

By providing an accurately located printwheel reference surface a substantial distance from the nominal plane of the printwheel, it is possible to utilize non-flat printwheels. Such a surface is present on the front face of the printwheel alignment member 26. It forces even the most out-of-plane spokes (within reasonable tolerance limits) into the proper position relative to the print throat "d". As the printwheel spins, several (about seven or eight) of the spokes adjacent the impact zone can be seen to be (note FIGS. 2 and 3) biased into conforming relationship with the alignment member. Thus, the nominal plane of the printwheel is set back from the ribbon to insure that ribbon flip cannot occur.

The alignment member is formed to span an arc concentric with the printwheel (see FIG. 3) and directly inboard of the character pad circle. This shape and location insures that as the outer ends of the spokes ride thereon as they spin past, following its contour (see FIG. 2), the character pads will be correctly positioned at the throat. The contour ramps up and ramps down rapidly, so that only the flat central portion, spanning about three or four spokes will be close to the ribbon while the remainder are quite remote therefrom. It has been found that the ramp-up gradient affects the level of "picket fence" noise, since too steep an angle induces noise, producing forced and sympathetic vibrations. The ideal ramp gradient is chosen by balancing its noise generation characteristics against the ribbon flip prevention design, in order to achieve a quieter surface that prevents ribbon flip.

In the present design of this printer it has also been required to form a notch 50 through the center of the printwheel alignment member 26. This has been necessitated by the need to maintain a close proximity of machine elements in the vicinity of the throat. More particularly, in the absence of the notch, when the pivotable member of the printer carriage 10 and the print tip 20 of the hammer are retracted during loading and unloading of the printwheel, there would be an interference between the print tip and the alignment member.

Having described the elements of the printer which affect the printwheel, it should be apparent that modification of the printhweel is in order for use in the quiet printer described above. To that end, I have modified it to eliminate the objectionable "picket fence" noise and to prevent wearing of the spokes in the narrow band directly radially inward of the character pads, where contact is made with the printwheel alignment member. The highly localized wearing of the spokes has been found to cause premature printwheel failure and perturbations to the spoke bending characteristics. Clearly, the notch 50 presents a source of catastophic failure.

A thin film wiping member 52 is secured to the rear surface of the printwheel 12. The wiping member must be flexible so as to conform to the contour of the printwheel alignment member. It must present a wear resistant, low friction surface facing the alignment member. It must be continuous in order to prevent the "picket fence" noise and span the notch 50. It must have a low mass so as not to appreciably affect the inertial characteristics of the rapidly spinning printwheel.

The preferred material for the wiping member is a disc of Mylar® polyester film, about 3 or 4 mils thick, which will offer low wear, flex conformity and minimum inertia. Other materials which may also be acceptable are low friction flourinated ethylene propylene copolymer (FEP), polyvinyl fluoride (Tedlar®) and polycarbonate. The preferred mounting can be seen in FIG. 3, wherein the wiping member 52 is positioned on pins 54 which initially extend axially outwardly from the rear side of the printwheel hub and are then ultrasonically staked to capture the wiping member. In this manner, the wiping member is not secured to the individual spokes and there will be no restriction to their normal bending in the lateral or axial direction. Although the disc may be made of a single material, it is certainly within the purview of this invention to fashion the wiping member with a ring of low friction material located solely in the outboard region where contact is made with printwheel alignment member. It is also possible to form the disc as a laminate if such were found to be desirable. The wiping member offers a large area upon which to imprint printwheel identifying indicia in both human and machine readable form. However, if the wiping member is made of transparent film material the printwheel identifying indicia imprinted upon the printwheel hub would be legible therethrough and the wiping member would be a universal part, attachable to any printwheel.

It should be understood that the present disclosure has been made only by way of example, and the numerous changes in details of construction and the combination and arrangement of parts may be resorted to without departing from the true spirit and scope of the invention as hereinafter claimed.

What is claimed:

1. A printwheel comprising a hub and a plurality of radially outwardly extending spokes, said spokes terminating in character pads bearing imprinting character surfaces facing the printing side of said printwheel and hammer receiving surfaces facing the hammered side of said printwheel, said printwheel being used in conjunction with a spoke alignment member which ramps said spokes out of the plane of said printwheel to a datum plane at which impact occurs, the improvement characterized by comprising means for reducing wear and noise caused as said spokes are moved against said alignment member, said means for reducing wear and noise being secured to said hub, being unsecured to said spokes, and lying adjacent to said spokes, on said hammered side, said means for reducing wear and noise including a continuous ring having a wear resistant surface facing away from said spokes, said ring being sufficiently flexible to conform to and be contacted by said interfering spoke alignment member, being located to be interposed between said spoke alignment member and said spokes, and being located radially inwardly of said character pads.

2. The printwheel as defined in claim 1 characterized in that said means for reducing wear and noise has a low moment of inertia.

3. The printwheel as defined in claim 2 characterized in that said means for reducing wear and noise is 3 to 5 mils thick.

4. The printwheel as defined in claim 1 characterized in that said means for reducing wear and noise is secured to said hub upon a plurality of positioning pins.

5. The printwheel as defined in claim 1 characterized in that said ring is made of polyester.

6. The printwheel is defined in claim 1 characterized in that said means for reducing wear and noise is transparent and said hub bears printwheel identification indicia.

7. The printwheel as defined in claim 1 characterized in that said means for reducing wear and noise bears printwheel identification indicia.

* * * * *